US010871337B1

(12) United States Patent
Zhou

(10) Patent No.: US 10,871,337 B1
(45) Date of Patent: Dec. 22, 2020

(54) PLUNGER DRIVEN RELOADING SYSTEM FOR REMOVABLE AMMUNITION MAGAZINES

(71) Applicant: Junsheng Zhou, Bensalem, PA (US)

(72) Inventor: Junsheng Zhou, Bensalem, PA (US)

( * ) Notice: Subject to any disclaimer, the term of this patent is extended or adjusted under 35 U.S.C. 154(b) by 0 days.

(21) Appl. No.: 16/777,840

(22) Filed: Jan. 30, 2020

(51) Int. Cl.
*F41A 9/83* (2006.01)

(52) U.S. Cl.
CPC ..... *F41A 9/83* (2013.01)

(58) Field of Classification Search
CPC ..... F41A 9/06; F41A 9/07; F41A 9/82; F41A 9/83
See application file for complete search history.

(56) References Cited

U.S. PATENT DOCUMENTS

| | | | | |
|---|---|---|---|---|
| 452,447 | A | 5/1891 | Bruce | |
| 1,786,537 | A | 12/1930 | Vaclav | |
| 2,356,806 | A | 8/1944 | Woodberry | |
| 2,402,195 | A | 6/1946 | Woodberry | |
| 2,403,012 | A | 7/1946 | McPheters | |
| 2,451,521 | A | 10/1948 | Uglum | |
| 2,542,842 | A | 2/1951 | Saunders | |
| 2,887,811 | A | 5/1959 | Johnson, Jr. | |
| 2,981,024 | A | 4/1961 | Skoff | |
| 3,283,425 | A | 11/1966 | Boyd | |
| 3,331,281 | A * | 7/1967 | Jäfvert | F41A 9/07 89/33.1 |
| 4,538,371 | A | 9/1985 | Howard | |
| 4,574,511 | A | 3/1986 | Csongor | |
| 4,614,052 | A | 9/1986 | Brown et al. | |
| 4,706,402 | A | 11/1987 | Csongor | |
| 4,707,941 | A | 11/1987 | Eastman | |
| 4,719,715 | A * | 1/1988 | Howard | F41A 9/83 42/87 |
| 4,939,862 | A | 7/1990 | Brandenburg et al. | |
| 5,107,751 | A * | 4/1992 | Grabner | F41A 9/375 89/34 |
| 5,301,449 | A | 4/1994 | Jackson | |
| 5,747,718 | A | 5/1998 | Bill et al. | |
| 6,257,115 | B1 | 7/2001 | Balsavage | |
| 9,335,108 | B2 | 5/2016 | Cauley, Jr. | |
| 9,354,008 | B1 | 5/2016 | Cifers et al. | |
| 9,574,836 | B1 | 2/2017 | Cauley, Jr. | |
| 9,689,633 | B1 | 6/2017 | Plate | |
| 9,719,741 | B1 | 8/2017 | Cifers et al. | |
| 9,846,005 | B2 | 12/2017 | Zivic | |
| 9,939,219 | B1 * | 4/2018 | Ulbrich | F41A 9/01 |
| 9,995,548 | B1 * | 6/2018 | Zhou | F41A 9/83 |
| 10,132,582 | B1 * | 11/2018 | Zhou | F41A 9/83 |

(Continued)

*Primary Examiner* — Gabriel J. Klein
(74) *Attorney, Agent, or Firm* — Lamorte & Associates P.C.

(57) ABSTRACT

A reloading system and method for reloading cartridges into a removable ammunition magazine of a gun. The reloading system has a storage container for holding a supply of cartridges. A collection chamber is fed from the storage container. The collection chamber has a magazine port for selectively interconnecting with the removable ammunition magazine. A plunger extends into the collection chamber. The plunger can be selectively advanced into the collection chamber to displace the cartridges out of the collection chamber and into the magazine.

10 Claims, 5 Drawing Sheets

(56) References Cited

U.S. PATENT DOCUMENTS

| | | | | |
|---|---|---|---|---|
| 2005/0081421 | A1* | 4/2005 | Guy | F41A 9/83<br>42/88 |
| 2013/0067788 | A1* | 3/2013 | Gray | F41A 9/84<br>42/88 |
| 2014/0033592 | A1 | 2/2014 | Fiorucci | |
| 2014/0298704 | A1 | 10/2014 | Niccum | |
| 2014/0317985 | A1 | 10/2014 | Cauley, Jr. | |
| 2014/0373421 | A1 | 12/2014 | Hatch | |
| 2015/0377573 | A1 | 12/2015 | Niccum | |

* cited by examiner

PLUNGER DRIVEN RELOADING SYSTEM FOR REMOVABLE AMMUNITION MAGAZINES

BACKGROUND OF THE INVENTION

1. Field of the Invention

In general, the present invention relates to systems and methods for rapidly reloading ammunition into the removable magazine of a rifle or pistol. More particularly, the present invention relates to portable systems that hold a large number of ammunition cartridges, wherein the system can be repeatedly used to rapidly refill an ammunition magazine by a soldier in the field.

2. Prior Art

Many makes and models of rifles and pistols are loaded using removable ammunition magazines. An ammunition magazine is a plastic or metal structure that is generally shaped like a box. The magazine has one open end. Inside the magazine is a spring biased platform. As cartridges are inserted into the magazine, the cartridges displace the platform against the spring bias. Once inserted into the magazine, the cartridges are biased toward the open end of the magazine. When the magazine is inserted into a rifle or pistol, the open end of the magazine is exposed to the breech of the gun. As the gun cycles, a cartridge is mechanically extracted from the magazine and loaded for firing.

The use of ammunition magazines is popular because it greatly decreases the amount of time and labor that is involved with reloading a gun. Using replaceable magazines, a rifle or pistol can be fully reloaded in only a few seconds. As a gun is being loaded, it cannot be fired. As such, it is very important to military personnel and law enforcement that the time required to reload the gun is minimal.

One disadvantage of using removable ammunition magazines is that it takes a significant amount of time and labor to reload the magazine after the magazine is emptied. Accordingly, soldiers, police officers and other such personnel attempt to reload empty magazines while in dangerous situations. Rather, soldiers and police officers prefer to carry a few preloaded magazines. When the magazines are empty, the soldier or officer is out of ammunition and must retreat to a safe location to either reload the empty magazines or to obtain additional preloaded magazines.

In the prior art, there are a myriad of devices that exist to reduce the time and labor needed to reload an ammunition magazine. Many of these devices are not designed to be portable and are impractical for use by a soldier or an officer in the field. Most other prior art devices, require the pressing of a lever or the turning of a crank to advance cartridges into an empty magazine. Consequently, such prior art devices require two hands to operate. One hand is needed to hold the reloading device and the other hand is needed to operate the reloading device. If a soldier needs two hands to reload ammunition into magazines, they must place down their weapon to free their hands. Obviously, this is undesirable on a battlefield or other dangerous situations. Prior art magazine reloading devices that require two hands to operate are exemplified by U.S. Pat. No. 4,574,511 to Csongor and U.S. Patent Application No. 2014/0033592 to Fiorucci.

Another disadvantage of prior art magazine reloading systems is that they typically only hold enough ammunition to reload a magazine one or two times. Since the reloading system is typically significantly larger than a magazine, it is much more practical to carry one or two extra pre-filled magazines than it is to carry one magazine reloading system.

U.S. Pat. No. 9,995,548 to Zhou sets forth a magazine reloading system that is capable of holding many rounds. In the Zhou system, the magazine is advanced into a reloading chamber. As the magazine is advanced, it passes over the ammunition cartridges and reloads. However, the shape and size of the magazine must match the shape and size of the reloading chamber in order for the magazine reloading system to work. In the marketplace, there are dozens of different makes and models of firearms and magazines. Many of the magazines differ in shape and size. Furthermore, many magazines are customized with auxiliary products, such as belt connectors. This alters the shape and size of the magazine. It also prevents the magazine from being reloaded using a prior art magazine reloading system.

A need therefore exists for a magazine reloading system that has the capacity and size to make it more practical to carry than pre-filled magazines. A need also exists for a magazine reloading system that can refill an empty magazine in only a few seconds regardless of the size, curvature and exterior features of the magazine. These needs are met by the present invention as described and claimed below.

SUMMARY OF THE INVENTION

The present invention is a reloading system and method for reloading cartridges into a removable ammunition magazine of a gun. The reloading system has a storage container that defines an internal compartment for holding a supply of cartridges. A plurality of parallel walls are positioned in the internal compartment. The parallel walls create columns within the internal chamber that are capable of holding multiple cartridges in stacked configurations. Each of the columns holding cartridges supply the cartridges to a common collection chamber.

The collection chamber has a magazine port for selectively interconnecting with the removable ammunition magazine. The collection chamber can be gravity fed with the cartridges from the storage container. Alternatively, the cartridges can be biased toward the collection chamber with spring elements. A plunger extends into the collection chamber. The plunger can be selectively advanced to displace the cartridges in the collection chamber out of the magazine port and into the magazine.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention magazine reloading system can be used to reload many types of removable ammunition magazines, the exemplary embodiments show the magazine reloading system being used to reload a magazine with a capacity of seven rounds. The embodiments are selected for ease of description and illustration, wherein the exemplary embodiments set forth two of the best modes contemplated for the invention. The illustrated embodiments, however, are merely exemplary and should not be considered limitations when interpreting the scope of the appended claims.

Figure 2:
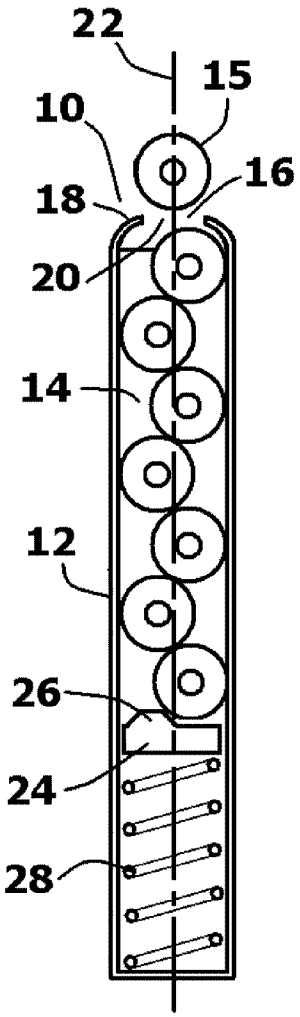
FIG. 2 PRIOR ART
FIG. 2 is a cross-sectional view of the embodiment of FIG. 1 viewed on section line 2-2.
Figure 1:
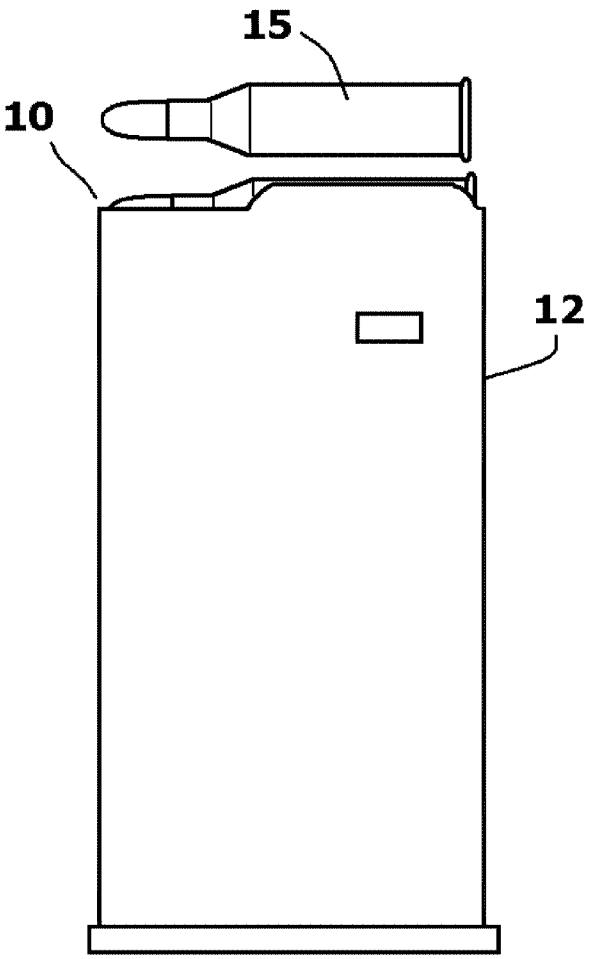
FIG. 1 PRIOR ART
FIG. 1 is a side view of a prior art ammunition magazine.

Referring to FIG. 1 in conjunction with FIG. 2, a prior art removable ammunition magazine 10 is shown. The ammunition magazine 10 has a housing 12. The housing 12 is typically metal or molded plastic. The housing 12 defines an internal chamber 14 that is sized to retain the ammunition cartridges 15 of a particular length and caliber. The internal chamber 14 is accessed through an opening 16 at one end of the housing 12. The opening 16 is partially obstructed by flared stops 18 that overlap sections of the opening 16. The flared stops 18 are positioned on opposite sides of the opening 16. The flared stops 18 extend a first distance D1 over the opening 16. A gap space 20 exists between the flared stops 18. The gap space 20 is aligned with the centerline 22 of the internal chamber 14. The gap space 20 is just wide enough to enable a cartridge 15 to pass through the gap space 20. In this manner, cartridges 15 can be loaded into the magazine 10 by manually advancing the cartridges 15 through the gap spaces 20.

Inside the internal chamber 14 is a platform 24. The platform 24 has a contoured surface 26. The contoured surface 26 causes any cartridge 15 that may be resting on the platform 24 to be positioned off-center from the centerline 22 of the internal chamber 14. In this manner, the cartridges 15 within the housing 12 do not directly align with the gap space 20 between the flair stops 18. This prevents the cartridges 15 from falling out of the magazine 10 through the gap space 20. The platform 24 is biased toward the opening 16 by a spring 28. Accordingly, any cartridge 15 resting on the contoured platform 24 is also biased toward the opening 16. Due to the offset of the cartridges 15 caused by the contoured surface 26 of the platform 24, the cartridges 15 become wedged under the flared stops 18 and are prevented from falling out of the magazine 10.

Figure 3:
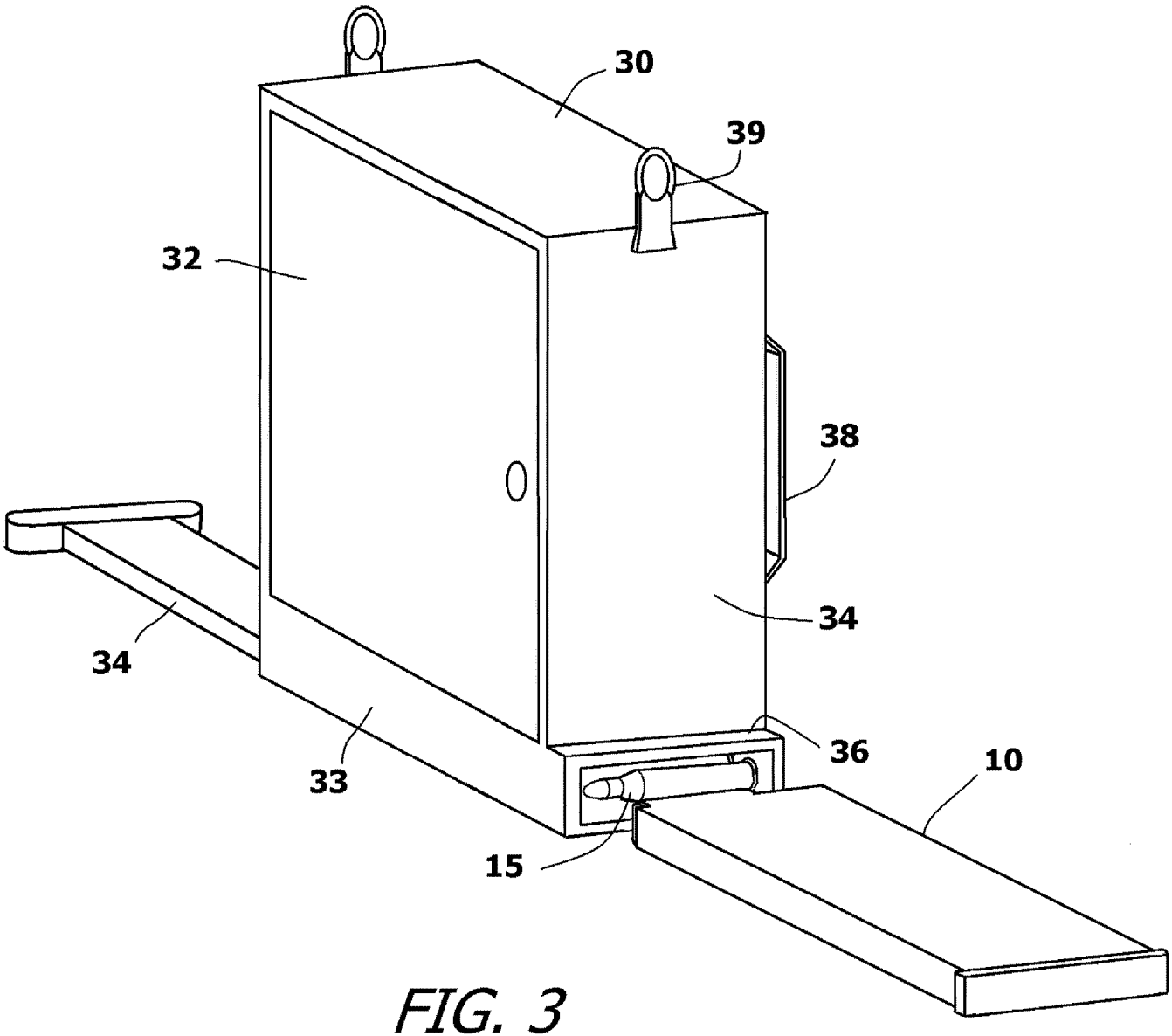
FIG. 3 shows the present invention reloading system in conjunction with the ammunition magazine of FIG. 1.

Referring to FIG. 3 in conjunction with FIG. 2, a reloading system 30 is shown. The reloading system 30 includes a refillable storage container 32. The storage container 32 has the capacity to hold a large number of cartridges 15 arranged in parallel. As will later be explained, the storage container 32 supplies cartridges 15 to a collection chamber 33 that is positioned below the storage container 32.

The collection chamber 33 has a magazine port 36 at one end. The magazine port 36 is sized and shaped to interconnect with the magazine 10. Once the magazine 10 is connected to the magazine port 36, the cartridges 15 can be advanced into the magazine 10 by manually advancing a plunger 34 into the end of the collection chamber 33 opposite the magazine port 36. The advancing plunger 34 displaces the cartridges 15 out of the collection chamber 33 and into the magazine 10, therein reloading the magazine 10. Accordingly, the magazine 10 can be reloaded as fast as the magazine 10 can be attached to the magazine port 36 and the plunger 34 is advanced. This takes only seconds. As a result, an empty magazine 10 can be reloaded nearly as fast as the magazine 10 can be replaced with another. The need to carry multiple magazines is, therefore, eliminated. A user need only carry the reloading system 30 and can reload the same magazine 10 multiple times.

The reloading system 30 is designed to be carried into action by a soldier. As such, the reloading system 10 can have belt loops 38, shoulder strap loops 39 or other such external features that enable the reloading system 30 to be easily carried.

Figure 4:
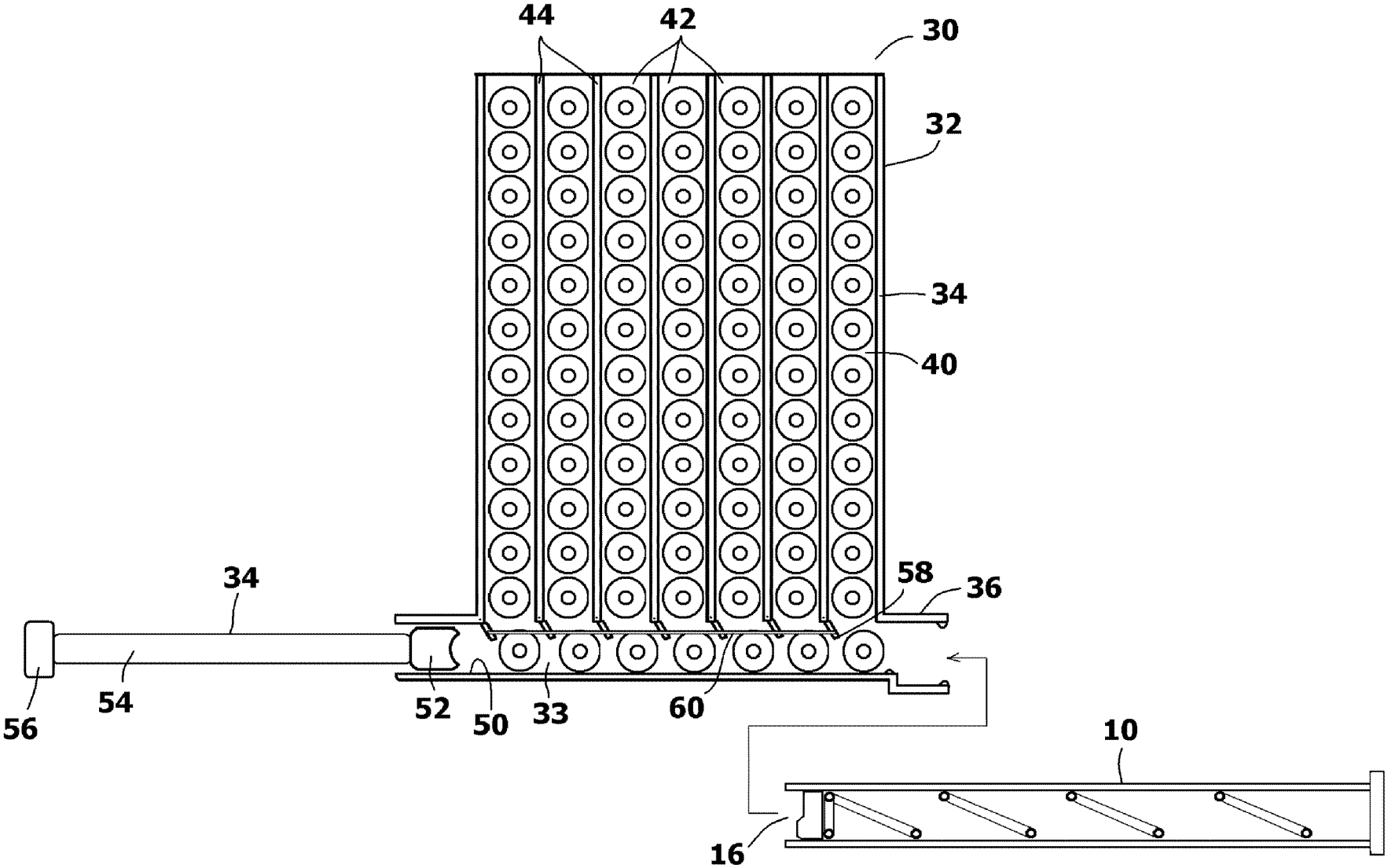
FIG. 4 shows a sectional view of the reloading system of FIG. 3.
Figure 5:
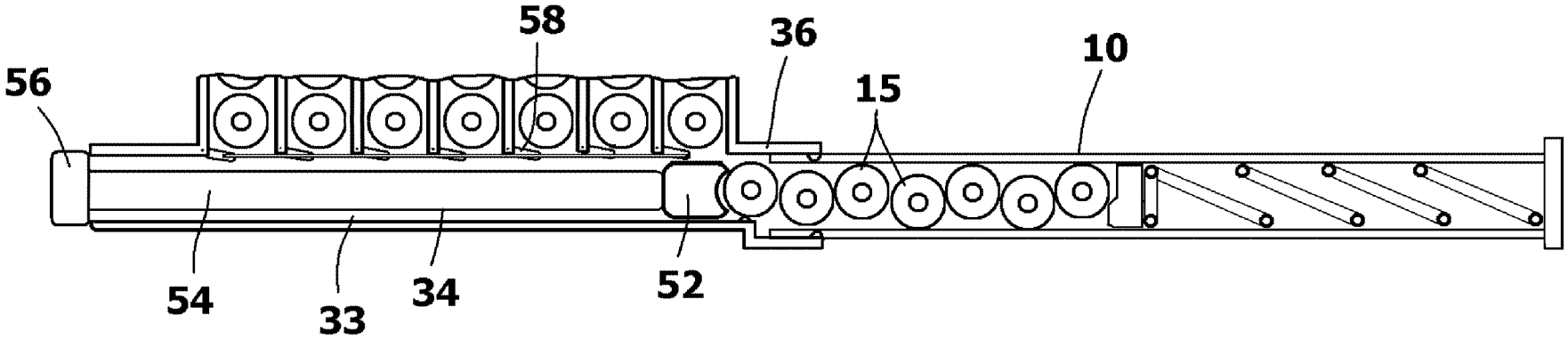
FIG. 5 is an enlarged view of FIG. 4 shown with a plunger partially advanced.

Referring to FIG. 4 and FIG. 5 in conjunction with FIG. 2 and FIG. 3, it can be seen that the storage container 32 defines an internal storage compartment 40. The cartridges 15 held within the internal storage compartment 40 are gravity fed into the collection chamber 33. If desired, a spring element can be added into the internal storage compartment 40 to help bias the cartridges 15 toward the collection chamber 33. There are isolated columns 42 within the internal storage compartment 40 of the reloading system 30. The columns 42 are parallel and are separated by column walls 44. There is enough space to hold a stack of horizontal cartridges 15 within each column 42. The number of cartridges 15 that can be stacked within each column 42 and the number of columns 42 are determined by the space available within the storage container 32 and the size of the cartridges 15.

All of the columns 42 have open bottom ends 46 that face the collection chamber 33. The collection chamber 33 has a top surface and an opposite bottom surface 50. The top surface is defined by the bottom ends 46 of the column walls 44. The bottom surface 50 is a generally planar surface. The collection chamber 33 has a height that enables the collection chamber 33 to hold one cartridge 15 from each of the columns 42 at any one time. The collection chamber 33 has two open ends. The first end terminates with the magazine port 36. The magazine port 36 can selectively connect to a magazine, therein aligning the collection chamber 33 with the central opening 16 in the magazine 10. The opposite end of the collection chamber 33 is open and receives the plunger 34. The plunger 34 is comprised of a plunger head 52, a shaft 54, and a handle 56. The plunger head 52 extends into the collection chamber 33 and is sized to pass into the collection chamber 33. The plunger head 52 can be manually advanced into the collection chamber 33 by pushing the shaft 54, via the handle 56.

Flaps 58 are present in the collection chamber 33. The flaps 58 mount to the column walls 44 so that the flaps 58 extend into the collection chamber 33. The flaps 58 are interconnected by linkages 60. In this manner, the movement of any one flap 58 is mechanically transferred to all the remaining flaps 58. The linkages 60 are attached to the sides of the flaps 58 and do not interfere with the ability of cartridges 15 to pass the flaps 58 as the cartridges 15 move from the storage container 32 to the collection chamber 33.

When the plunger head 52 is initially advanced into the collection chamber 33, the plunger head 52 contacts the first of the flaps 58 and rotates that flap upward. This obstructs the first column 42 and isolates the cartridges 15 in the first column 42. Due to the linkages 60 between the flaps 58, the movement of the first flap 58 is mimicked by all the remaining flaps 58. This isolates all the cartridges 15 in all the columns 42 that have not already dropped down into the collection chamber 33. Once the plunger 34 is again retracted, the flaps 58 automatically return to their original positions.

With continued reference to FIG. 5 and FIG. 4, it can be seen that the storage container 32 of the reloading system 30 is opened and cartridges 15 are placed into the columns 42. Gravity and/or spring elements cause the cartridges 15 to fall into the collection chamber 33 below the columns 42. One cartridge 15 from each column 42 enters the collection chamber 33. The cartridges 15 are held in place under the columns 42 by the flaps 58. The result is that the collection chamber 33 is filled with a row of cartridges 15, wherein the number of cartridges 15 corresponds to the number of columns 42.

The magazine 10 is attached to the magazine port 36. The plunger 34 is manually pulled back into its fully retracted position. This causes the flaps 58 to straighten and the cartridges 15 to drop into the collection chamber 33. Within the collection chamber 33, the cartridges 15 are aligned with the gap space 20 between the flared stops 18 of the magazine 10. The plunger 34 is then manually pushed forward into the collection chamber 33. As the plunger 34 advances into the collection chamber 33, the cartridges 15 are pressed through the gap space 20 and into the magazine 10.

As the plunger 34 is advanced to the rear of the collection chamber 33, all of the cartridges 15 in the collection chamber 33 are transferred into the magazine 10. Once a magazine 10 is full, it is removed from the magazine port 36. The plunger 34 can be left in the collection chamber 33, therein preventing any other cartridges 15 from falling into the collection chamber 33. The reloading system 30 is then safe to travel without any concerns of cartridges 15 falling out or becoming dislodged. Once another magazine 10 needs to be reloaded, that magazine 10 is attached to the magazine port 36. The plunger 34 is manually retracted, therein enabling cartridges 15 to again fall into the collection chamber 33. The plunger 34 is advanced and the magazine 10 reloaded.

In the primary embodiment, a reloading system 30 is shown that reloads seven cartridges 15 into a magazine 10 each time the magazine 10 is inserted into the reloading system 30. It will be understood that the use of seven cartridges 15 is arbitrary. The reloading system 30 can have any number of columns 42 and can hold any number of cartridges 15 in the collection chamber 33. Additionally, it should be understood that the same magazine 10 can be inserted into the reloading system 10 multiple times. For example, the reloading system 10 can be configured to hold ten cartridges 15 in the collection chamber 33. A rifle magazine may be provided that has a capacity of thirty cartridges 15. To reload the magazine, the magazine would be inserted into the reloading system three times in rapid succession. Each time the magazine is inserted into the reloading system 10, ten cartridges 15 are transferred into the magazine. Accordingly, after three insertions, the magazine would be at capacity.

Figure 6:
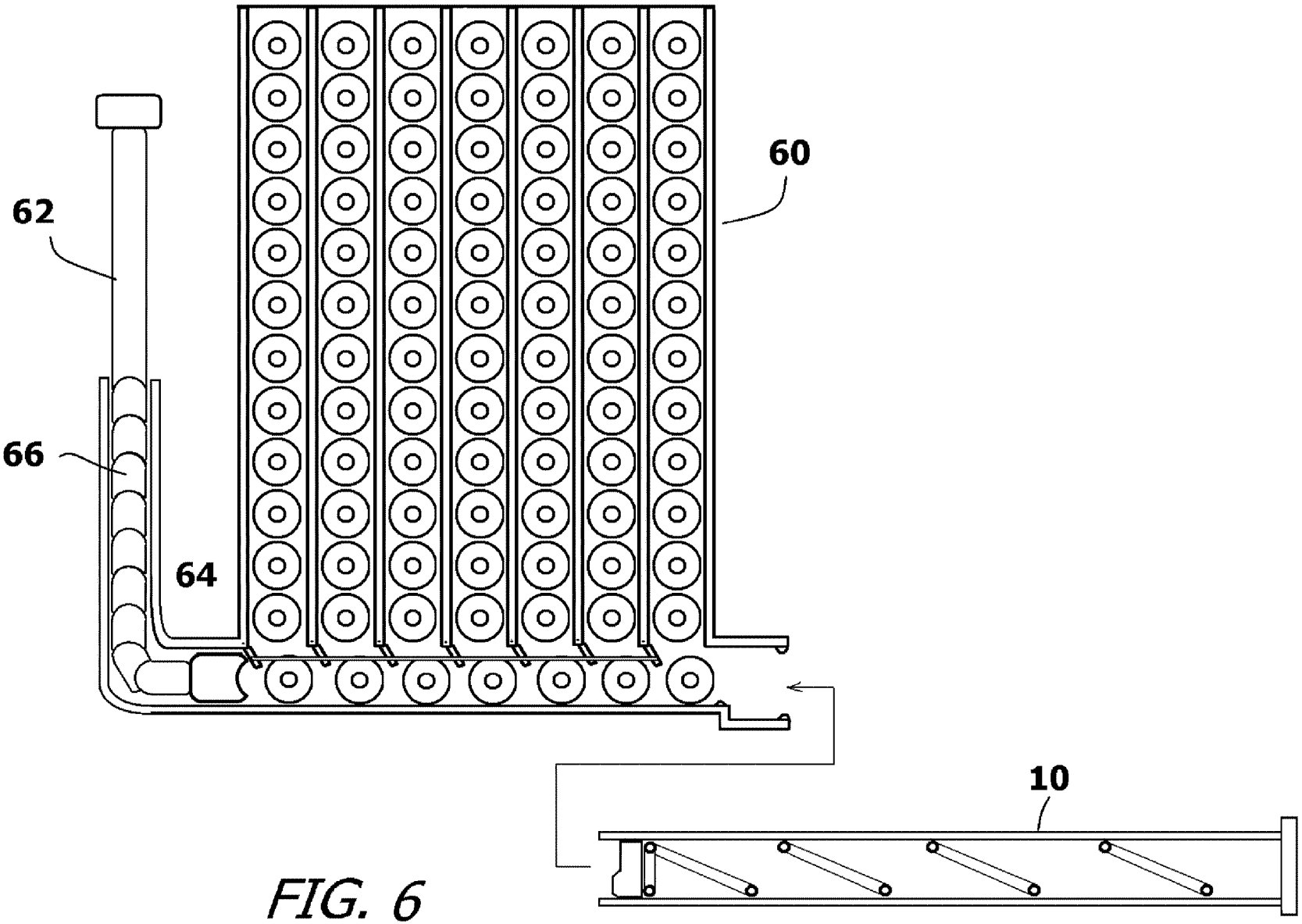
FIG. 6 is an alternate embodiment of the present invention that utilizes a flexible plunger.

Referring to FIG. 6, an alternate embodiment of a reloading system 60 is shown. In this embodiment, the plunger 62 has a plunger head 64 that is connected to a segmented shaft 66. The segmentation makes the shaft 66 flexible, wherein the shaft 66 is capable of bending at least ninety degrees. As such, the segmented shaft 66 can be oriented along the side of a supply container 68. This enables a person to push and pull the plunger 62 vertically, rather than horizontally. Otherwise, the operation of the reloading system 60 remains the same as previously described.

It will be understood that the embodiments of the present invention that are illustrated and described are merely exemplary and that a person skilled in the art can make many variations to those embodiments. All such embodiments are intended to be included within the scope of the present invention as defined by the appended claims.

What is claimed is:

1. A reloading system for reloading cartridges into a removable ammunition magazine of a gun, said system comprising:

a storage container that defines an internal compartment that is capable of holding said cartridges;

a collection chamber having a magazine port for selectively interconnecting with said removable ammunition magazine, wherein said collection chamber is fed with said cartridges from said storage container; and a plunger that extends into said collection chamber, said plunger having a handle, a plunger head, and a shaft that extends between said handle and said plunger head, wherein said shaft is flexible and enables said shaft to bend at least ninety degrees, wherein said plunger can be selectively advanced into said collection chamber to displace said cartridges in said collection chamber into said magazine.

2. The system according to claim 1, wherein said shaft is segmented.

3. The system according to claim 1, further including a plurality of parallel walls within said internal compartment that creates columns, wherein said columns have open ends that lead into said collection chamber.

4. The system according to claim 3, further including flaps that obstruct said columns when said plunger is advanced within said collection chamber.

5. A reloading system for reloading cartridges into a removable ammunition magazine of a gun, said system comprising:

a collection chamber accessible through a magazine port, wherein said magazine port can selectively receive and retain said removable ammunition magazine;

a plurality of supply columns that lead into said collection chamber through a top surface, wherein each of said supply columns retains a plurality of cartridges therein;

a plunger that extends into said collection chamber, said plunger having a handle, a plunger head, and a shaft that extends between said handle and said plunger head, wherein said shaft is flexible and enables said shaft to bend at least ninety degrees, wherein said plunger can be advanced through said collection chamber, therein displacing said cartridges in said collection chamber through said magazine port and into said removable ammunition magazine.

6. The system according to claim 5, wherein said shaft is segmented.

7. The system according to claim 5, further including flaps that obstruct said plurality of supply columns when said plunger is advanced within said collection chamber.

8. A method of reloading cartridges into a removable ammunition magazine of a gun, said method comprising the steps of:

providing a collection chamber that is accessible through a magazine port, wherein said collection chamber is connected to a stored supply of cartridges that fill said collection chamber with some of said cartridges after each time said collection chamber is emptied;

attaching said removable ammunition magazine to said collection chamber at said magazine port;

advancing a flexible plunger in a first direction, wherein said flexible plunger bends and enters said collection chamber in a second direction, said plunger having a handle, a plunger head, and a shaft that extends between the handle and said plunger head, wherein said shaft is flexible and enables said shaft to bend at least ninety degrees, wherein said plunger displaces said cartridges in said collection chamber through said magazine port and into said removable ammunition magazine.

9. The method according to claim 8, wherein said stored supply of cartridges is held in a storage container that uses a gravity feed to supply said cartridges to said collection chamber.

10. The method according to claim 9, further including preventing said storage container from supplying said collection chamber as said plunger is advanced through said collection chamber.

* * * * *